United States Patent [19]

Keller

[11] Patent Number: 4,467,480

[45] Date of Patent: Aug. 28, 1984

[54] TOILET BOWL WATER CONDITIONER

[76] Inventor: Philip B. Keller, 1527 Pontius Ave., Los Angeles, Calif. 90025

[21] Appl. No.: 560,323

[22] Filed: Dec. 12, 1983

Related U.S. Application Data

[63] Continuation-in-part of Ser. No. 440,751, Nov. 12, 1982, abandoned.

[51] Int. Cl.[3] ..... E03D 9/02

[52] U.S. Cl. ..... 4/225

[58] Field of Search ..... 4/222–228

[56] References Cited

U.S. PATENT DOCUMENTS

| | | | |
|---|---|---|---|
| 2,697,841 | 12/1954 | Collins | 4/228 |
| 2,761,151 | 9/1956 | Ferrando | 4/225 |
| 3,112,499 | 12/1963 | Thornton | 4/226 X |
| 3,228,040 | 1/1966 | Currie | 4/226 |
| 3,290,698 | 12/1966 | Joyner et al. | 4/228 |

FOREIGN PATENT DOCUMENTS

| | | | |
|---|---|---|---|
| 120753 | 6/1927 | Switzerland | 4/226 |

*Primary Examiner*—Charles E. Phillips

*Attorney, Agent, or Firm*—Beehler, Pavitt, Siegemund, Jagger & Martella

[57] ABSTRACT

Means are provided to condition the water in a toilet bowl in the form of a receptacle suspended in the overflow pipe below the discharging end of the auxiliary water pipe which extends from the float operated water inlet valve. The receptacle contains a conditioning chemical and captures only a portion of the water discharged from the auxiliary pipe, the rest being passed down around the receptacle. The captured water is placed in contact with the chemical to form a solution which is trickled out of the receptacle and down through the overflow pipe into the toilet bowl, thereby to condition the water standing in the bowl.

3 Claims, 7 Drawing Figures

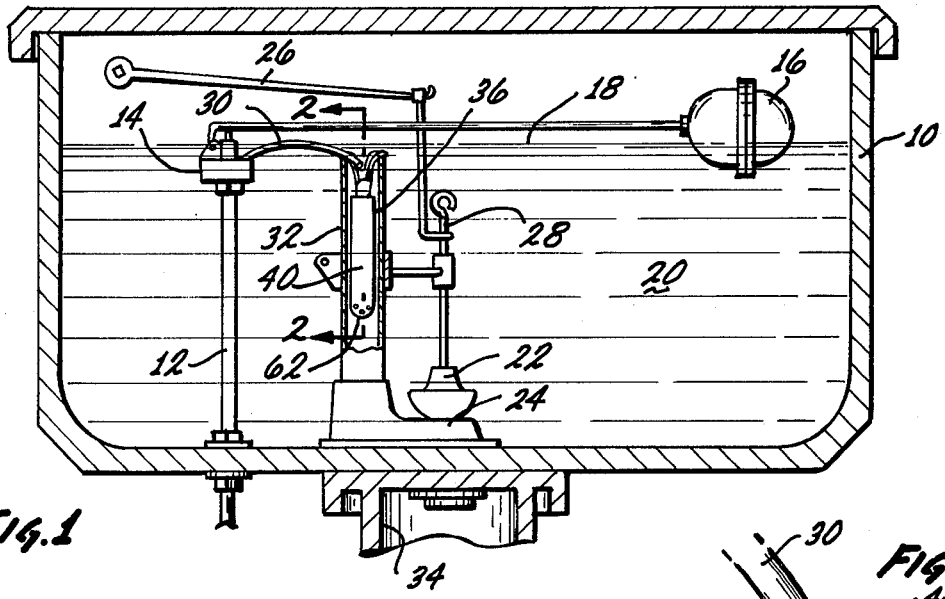
FIG. 1
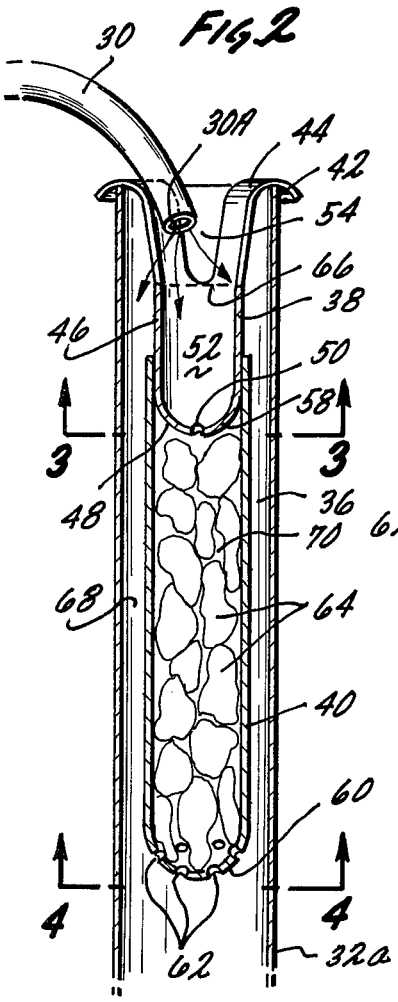
FIG. 2
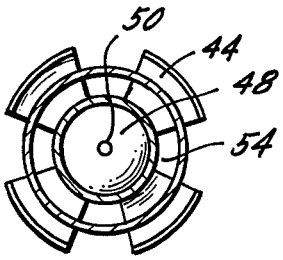
FIG. 3
FIG. 4
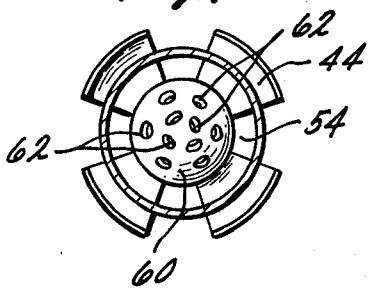
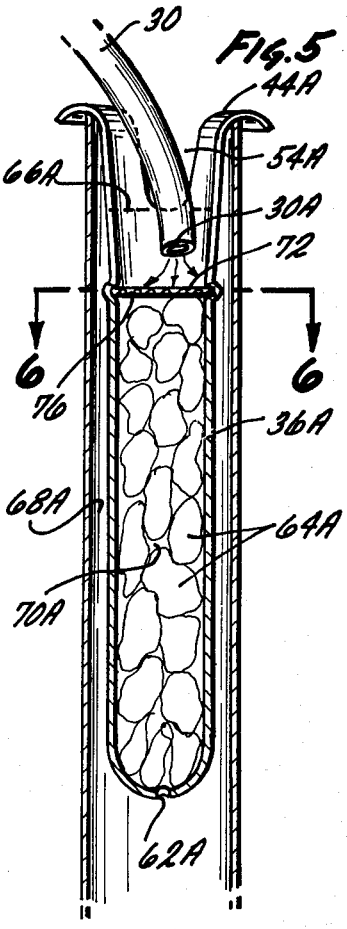
FIG. 5
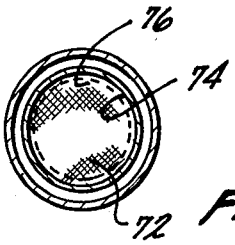
FIG. 6

TOILET BOWL WATER CONDITIONER

This application is a continuation-in-part of application Ser. No. 06/440,751 filed Nov. 12, 1982, now abandoned.

FIELD OF THE INVENTION

This invention relates to means for chemically conditioning the water and toilet bowls by providing chemical conditioning means within the confines of the water tank.

BACKGROUND OF THE INVENTION

Efforts have been made to disinfect or sanitize toilets for more than a hundred years, as evidenced by the patent to Warren which was granted in 1882.

Prior art devices to effect sanitization of toilet bowls have generally taken three forms, namely: (1) by hanging a water soluble deodorant bar from the rim of the toilet bowl itself, as for example, U.S. Pat. No. 3,668,717 granted June 13, 1972 to Curran; (2) by hanging a container of disinfectant chemical from the rim of the side wall of the water tank or otherwise disposing it in the tank, as illustrated by U.S. Pat. Nos. 2,591,817; 2,807,807 and 4,318,891; and (3) by feeding some type of solution into the overflow pipe within the toilet tank, as illustrated by U.S. Pat. Nos. 2,570,934; 2,697,841 and 4,312,082.

The present inventor has been of the view that the third approach to the toilet bowl sanitization is the best, but the prior art devices have been either too expensive or complex and/or wasteful of the sanitizing chemical utilized in such prior art devices.

Where the device is complex it invariably becomes quite expensive both to acquire and have installed, since in most instances the installation will have to be accomplished by a licensed plumber. Where the device is wastful of the sanitizing chemical, it may not only oversanitize the toilet bowl, but the chemical-containing receptacle or vessel will have to be replaced quite frequently. It should be remembered that with respect to the more than one hundred million flush toilets which are found in the vast majority of homes in the United States, the cleaning and servicing of the toilet usually falls to the housewife or to a domestic helper, neither of whom may be particularly qualified to undertake even any minor plumbing replacement of sanitizing chemical containers of the prior art devices. Thus, the less frequently a container has to be replaced in order to provide adequate sanitization and the simpler the replacement operation, the more any such sanitizing device is likely to be utilized. Moreover, as an inherent concomitant, the simpler the device and the longer it lasts, the less expensive it will be for the user.

BRIEF DESCRIPTION OF THE INVENTION

The present invention obviates the criticism of the prior art devices in that it is quite easy to install and replace. Moreover, it is structured to utilize only a portion of the water which is discharged into the overflow pipe and this portion, when passed through a chemical container, serves to provide a small amount of solution which may be fed into the toilet bowl through the overflow pipe in which the device of the present invention is suspended. Thereby, the contained chemical may be made to last for several thousand flushes, which, in normal usage of the toilet, could extend over many months of the year. Further, because only a small amount of the chemical entrained in the solution is fed into the toilet bowl, the water in the bowl may be adequately sanitized without acquiring a strong smell of chlorine or other sanitizing chemical.

The present invention accomplishes its objectives by providing a receptacle to be suspended from the rim of the overflow pipe in such a manner as to receive the discharge from the auxiliary pipe which, in the usual toilet tank, extends from the float operated valve to the overflow pipe in order to complete the filling of the toilet bowl after a flushing operation. The receptacle, however, only serves to receive and retain a relatively small quantity of the water discharged by the auxiliary pipe into the overflow tube, the balance of this water being permitted to bypass the receptacle and flow around it down through the overflow tube. The receptacle is provided with a chamber which contains the sanitizing chemical in preferably a large crystalline form. In one form of the invention a predetermined amount of water is captured in an upper chamber and is then fed slowly through the chemical to pass out through orifices in the lower end of the receptacle into the overflow tube and thence, into the toilet bowl. In another embodiment, the predetermined amount of water may be captured in the chamber which holds the chemical itself, and the resulting solution is then fed out through a relatively small orifice at the bottom of the receptacle itself into the overflow tube.

Because only a small predetermined amount of water is effectively captured by the receptacle from the discharge into the overflowing pipe, only a small amount of the water conditioning chemical actually goes into solution, and hence, the chemical will last for a much longer period than would be possible with the device of U.S. Pat. No. 2,697,841 where all of the discharge is forced through the chemical in the receptacle.

In a still further embodiment of the invention, no orifice is provided in the lower end of the receptacle in which end the chemical granules are contained and a small portion of the water received by the receptacle is captured, so that a saturated solution of the chemical is continuously maintained between flushes. However, one or more small orifices are provided in the side wall of the receptacle toward the upper level of the chemical granules with the result that, with each flushing and receipt by the receptacle of water from the auxiliary pipe, such water becomes mixed with the saturated solution and is seeped out through the side wall orifice or orifices to pass into the overflow tube between the inner wall of the latter and the outer wall of the receptacle. Thus, in this embodiment as well as in the first two described above, only a small amount of the saturated chemical solution is utilized with each flushing.

Moreover, in contrast to the effort which is required to replace the device of said U.S. Pat. No. 269,841, with the present invention, it is only necessary for the housewife or other person servicing the toilet, to raise the discharge end of the auxiliary pipe, lift out the entire spent receptacle, insert a replacement back into the overflow pipe and lower the discharge end of the auxiliary pipe back into its normal position.

Because of its simplicity, the device of the present invention may be molded inexpensively of plastic material and filled with a water conditioning chemical in a simple operation.

The device of the present invention, therefore, offers many advantages over prior art devices.

DESCRIPTION OF THE DRAWINGS

In the accompanying drawings,

FIG. 1 is a section of a toilet tank showing the manner in which the device of the present invention is installed;

FIG. 2 is an enlarged section taken in the direction of the arrows along the line 2—2 of FIG. 1;

FIG. 3 is a section taken along the line 3—3 in the direction of the arrows in FIG. 2;

FIG. 4 is an end view, partly in section, taken in the direction of the arrows on the line 4—4 of FIG. 2;

FIG. 5 is a view similar to FIG. 2 of an alterative embodiment of the present invention;

FIG. 6 is a section taken in the direction of the arrows on the line 6—6 of FIG. 5.

DESCRIPTION OF THE PREFERRED EMBODIMENT

Figure 7:
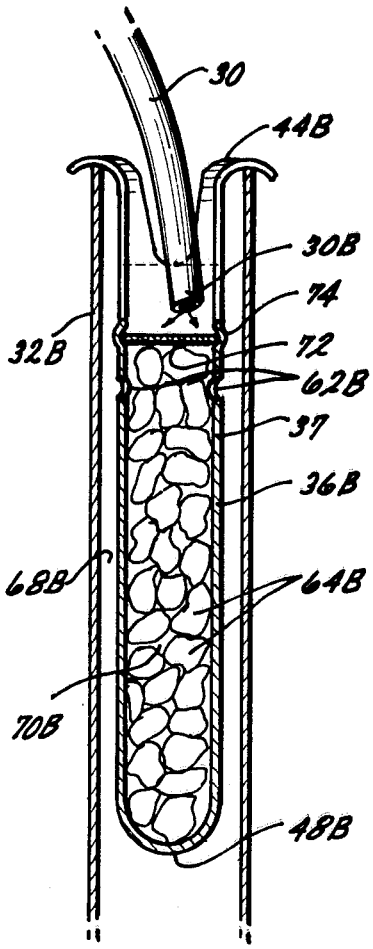
FIG. 7 is a view similar to FIG. 2 of a further embodiment of the invention.

Referring to FIG. 1, the numeral 10 designates a conventional toilet tank which is filled through an inlet pipe 12 which is capped by a valve 14 operated by a float 16 responsive to the level 18 of the water 20. Flushing is accomplished by raising the rubber valve 22 from its seat 24 by the action of the arm 26 upon the valve stem 28. When the float 16, is lowered by the flushing action, the valve 14 opens to permit water from the inlet pipe 12 to flow into the tank 10, thereby to replace the water which was released through the flushing action. At the same time a small amount of water is passed by the valve 14 through the auxiliary pipe 30 to be discharged into the overflow tube 32 which is in direct communication with the head 34 of the toilet bowl (not shown).

The device of the present invention may be best understood by consideration of FIGS. 2 through 4. A receptacle 36 which, in this instance, may be comprised of two interfitting tubular elements 38 and 40, is suspended from rim 42 of the overflow tube or pipe 32 by a plurality of straps 44 extending upwardly from the element 38. The straps 44 desirably are integrally molded with the lower cylindrical segment 46 of the element 38. The latter is closed at its lower extremity 48 except for a relatively small orifice 50, thereby to define an upper chamber 52 which is open at its top. The straps 44 are spaced from each other to provide a slotting 54 between them. The lower tubular element 40 may be of sufficiently larger inside diameter at its open top 56 to fit closely about the lower cylindrical wall 58 of the upper element 38. The lower end 60 of the element 40 is also closed, except for a plurality of larger openings 62. Element 40 may be filled with a disinfecting or other type of water conditioning chemical 64 in a fairly large crystalline or other state which would permit the passage of water down through the thus enclosed chemical. The entire receptacle 36 may be placed just below the discharge opening 30*a* of the auxiliary pipe 30.

In operation, when the valve 14 is opened to cause water to flow through the auxiliary pipe, this water is discharged principally into the chamber 52 until it reaches the level 66 at the base of the straps 44, whereupon any further water which is so discharged will flow out through the slotting 54 and down the annular passage 68 around the outside of receptacle 36. Immediately upon the filling of the chamber 52 with water, and continuing after the valve 14 shuts off further flow of water through the auxiliary pipe 30, until the chamber 52 is emptied, the water in the chamber 52 will trickle or seep through the orifice 50 to pass through the chemical 64 in the lower chamber 70 defined by the lower tubular element 40. As the water passes through the chemical 64, it will entrain a small amount of the chemical into solution, which solution will then pass through the orifices 62 at the lower extremity of the element 40. This solution thus is admitted through the lower portion 32*a* of the overflow tube or pipe 32 into the head 34 of the toilet bowl, thereby to condition or disinfect the water in the bowl.

In the alternative embodiment of FIG. 5, the receptacle 36A is formed as a singular tubular element having integral strapping 44A similar to the strapping 44 in the embodiment of FIGS. 2 through 4. The element 36A, however, defines but a single chamber 70A, the lower portion of which is filled with a similar chemical 64A. The chemical 64A, however, is retained by a screen or orifice plate 72 snapped into an annular recess 74 in the wall 76 of the element 36A.

In this second embodiment, as water is discharged from the end 30A of the auxiliary pipe 30, a certain amount is initially captured in the tubular element 36A until the water level reaches the base 66A of the strapping 44A, whereupon it flows through the slotting 54A and down the annular passage 68A about the element 36A in the same manner as in FIGS. 2 through 4 embodiment. The water thus initially captured passes over the chemical 64A and produces a solution which then trickles or seeps out of the small orifice 62A at the lower end of the element 34A.

In the embodiment of the invention shown in FIG. 7, the receptacle 36B, like 36A of the FIG. 5 embodiment, is formed as a singular tubular element having integral strapping 44B and defining a single chamber 70B filled with chemical granules 64B. The chemical granules 64B may be held in the chamber 70B by a transverse screen or orificed plate 72 in the same manner as in the FIG. 5 embodiment. The lower extremity 48B of the receptacle 36B, however, is not orificed, but is completely closed. Instead, preferably the side wall 37 is provided with at least one small orifice 62B toward the top of the chamber 70B.

It may thus be seen that with the FIG. 7 embodiment of the invention, a portion of water arriving in the receptacle 36B from the pipe 30 is captured in the chamber 70B where a certain amount of the chemical granules 64B is dissolved to form a saturated solution, with that portion of such solution at or above the level of the orifice 62B then seeping out into the annular passage 68B between the receptacle 36B and the inner wall of the overflow pipe 32B. When more water arrives in the receptacle 36B with the next flushing of the toilet, it will first mix with the standing saturated solution in the chamber 70B and then seep out through the orifice 62B to sanitize the bowl through the pipe 32B.

It will readily be appreciated that the devices of these three embodiments may be inexpensively fabricated. Because only a small amount of chemical is utilized to produce the conditioning solution fed into the toilet bowl after each flushing, and particularly by proper selection of chemical conditioner and dimensioning of the chambers to limit the amount of water initially captured upon discharge from the auxiliary pipe 30, the conditioning element may be made to last through thousands of flushing operations.

It will also be appreciated that the device may readily be installed by persons without any plumbing expertise.

What is being claimed:

1. For use in a toilet tank having an upwardly extending water inlet pipe capped by a float operated valve which valve, in its open position passes most of the water to refill the tank and a small quantity of water through a pipe extending horizontally to discharge the same into an open overflow tube, the lower end of which overflow tube is in communication with the toilet bowl, to complete refilling of the bowl after flushing;

means to sanitize the water in the toilet bowl, said means comprising:

(a) an open top tubular receptacle disposed inside and below the open top of the overflow tube, said receptacle having a cross-sectional dimension sufficiently less than the inside diameter of said overflow tube to permit water to flow between the tubular receptacle and inner wall of the overflow tube;

(b) a transverse partition interposed between the upper and lower ends of said receptacle to form, with the tubular wall of the receptacle a first upper chamber and a second lower chamber, said partition being provided with at least one small orifice to allow water, when contained in the first chamber, to seep down into the second chamber, said second chamber being provided with a predetermined quantity of water conditioning chemical and orificed means at the lower end of the receptacle to retain said chemical, and said chemical being in such a state in said second chamber as to permit water seeping into the second chamber from the first chamber to pass through said chemical and dissolve a portion thereof with the resulting solution further passing the orificed retaining means and down into the overflow tube, and from there into the toilet bowl; and (c) means to suspend the receptacle below the discharging end of said horizontally extending pipe thereby to enable the first chamber to become filled with water when discharge occurs from said pipe with the excess of the water required for such filling passing directly down between the receptacle and the wall of the overflow tube surrounding the receptacle.

2. For use in a toilet tank having an upwardly extending water inlet pipe capped by a float operated valve which valve, in its open position passes most of the water to refill the tank and a small quantity of water through a pipe extending horizontally to discharge the same into an open top overflow tube, the lower end of which overflow tube is in communication with the toilet bowl, to complete refilling of the bowl after flushing;

means to sanitize the water in the toilet bowl, said means comprising:

(a) an open top tubular rceptacle disposed inside and below the open top of the overflow tube, said receptacle having a cross-sectional dimension sufficiently less than the inside diameter of said overflow tube to permit water to flow between the tubular receptacle and inner wall of the overflow tube;

(b) a transverse wall disposed in the vicinity of the lower end of said receptacle to form, with the tubular wall of the receptacle a chamber, said wall being provided with at least one small orifice to allow water, when contained in the chamber, to seep out of the chamber, said chamber being provided with a predetermined quantity of a water conditioning chemical and orificed transverse means at the upper end of the receptacle to retain said chemical in the chamber when the latter is filled with water, said chemical being such a state in said chamber as to permit water entering the chamber from the discharging pipe to pass through said transverse means and said chemical and dissolve a portion of said chemical with the resulting solution then seeping through the small orifice into the overflow tube to pass into the toilet bowl; and (c) means to suspend the receptacle below the discharging end of said horizontally extending pipe thereby to enable the chamber to become filled with water when discharge occurs from said pipe with the excess of the water required for such filling passing out through said means to suspend and directly down between the receptacle and the wall of the overflow tube surrounding the receptacle.

3. For use in a toilet tank having an upwardly extending water inlet pipe capped by a float operated valve which valve, in its open position passes most of the water to refil the tank and a small quantity of water through a pipe extending horizontally to discharge the same into an open top overflow tube, the lower end of which overflow tube is in communication with the toilet bowl, to complete refilling of the bowl after flushing;

means to sanitize the water in the toilet bowl, said means comprising:

(a) a tubular receptacle disposed inside the overflow tube, said receptacle having a cross-section dimension sufficiently less than the inside diameter of said overflow tube to permit water to flow between the tubular receptacle and inner wall of the overflow tube, said receptacle having passage means for allowing water from said pipe to enter said receptacle;

(b) a transverse wall disposed in the vicinity of the lower end of said receptacle to form, with the tubular wall of the receptacle, a chamber, at least one of said transverse wall and said tubular wall of said chamber being provided with at least one small orifice to allow water, when contained in the chamber, to seep out of the chamber, said chamber being provided with a predetermined quantity of a water conditioning chemical and orificed transverse means at the upper end thereof to retain said chemical in the chamber when the latter is filled with water, said chemical being in such a state in said chamber as to permit water entering the chamber from the discharging pipe to pass through said transverse means and said chemical and dissolve a portion of said chemical, with the resulting solution then seeping through the small orifice into the overflow tube to pass into the toilet bowl; and (c) means to suspend the receptacle in said overflow tube to provide communication between said pipe and said passage means and to provide a path for excess water between said receptacle and said pipe, whereby the chamber will become filled with water when discharge occurs from said pipe with the excess of the water required for such filling passing out over the upper end of the receptacle and directly down between the receptacle and the wall of the overflow tube surrounding the receptacle.

* * * * *